US005224867A

United States Patent [19]

Ohtsuki et al.

[11] Patent Number: 5,224,867

[45] Date of Patent: Jul. 6, 1993

[54] ELECTRICAL CONNECTOR FOR COAXIAL FLAT CABLE

[75] Inventors: Tomonari Ohtsuki; Kazuyuki Ozai, both of Tokyo, Japan

[73] Assignee: Daiichi Denshi Kogyo Kabushiki Kaisha, Japan

[21] Appl. No.: 970,642

[22] Filed: Nov. 2, 1992

Related U.S. Application Data

[63] Continuation of Ser. No. 769,878, Oct. 1, 1991, abandoned.

[30] Foreign Application Priority Data

Oct. 8, 1990 [JP] Japan ..... 2-271918
Oct. 8, 1990 [JP] Japan ..... 2-271919

[51] Int. Cl.[5] ..... H01R 13/00
[52] U.S. Cl. ..... 439/108; 439/497
[58] Field of Search ..... 439/92, 108, 492–499, 439/578–581, 607, 610

[56] References Cited

U.S. PATENT DOCUMENTS 4,850,887 7/1989 Sugawara ..... 439/108
5,145,387 9/1992 Ichihashi ..... 439/108

FOREIGN PATENT DOCUMENTS 61-114671 7/1986 Japan .
61-227386 10/1986 Japan .
61-269876 11/1986 Japan .

*Primary Examiner*—Joseph H. McGlynn
*Attorney, Agent, or Firm*—Silverman, Cass & Singer, Ltd.

[57] ABSTRACT

An electrical connector for a coaxial flat cable, includes pairs of contacts, each consisting of signal contacts and ground contacts and an insulating body for securely holding the contacts. Connection terminals of the pairs of the contacts are arranged in every pair in a row in a flat plane so that the signal contacts and the ground contacts are alternately arranged. The contact portions of the signal contacts and the contact portions of the ground contacts are arranged in every pair in one row and also the other row. The contact portions of the signal contacts of two adjacent pairs are arranged in different rows and the contact portions of the ground contacts of the two adjacent pairs are arranged in different rows. In another aspect, the contact portions of the pairs of contacts of odd numbers and even numbers are arranged in every pair in one row and also in the other row, respectively, so that the signal contacts and the ground contacts are alternately arranged. The contact portions of the signal contacts and the ground contacts in the one row are substantially in opposition to the contact portions of the ground contacts and the signal contacts in the other row, respectively.

1 Claim, 6 Drawing Sheets

ELECTRICAL CONNECTOR FOR COAXIAL FLAT CABLE

This is a continuation of application Ser. No. 07/769,878 filed Oct. 1, 1991 now abandoned.

BACKGROUND OF THE INVENTION

This invention relates to an electrical connector for a coaxial flat cable used for an electronic appliance, and more particularly to a multicontact connector which operates with high transmission efficiency and less crosstalk.

With development of electronics, electronic circuits used in electronic appliances have been designed to pass low voltage and small electric current or high frequency current. Under such circumstances, small diameter coaxial cables have been widely used for connection between electronic appliances or between circuit boards thereof.

Coaxial flat cables have been used for connecting electronic appliances or circuit boards thereof. In general, a coaxial flat cable includes a plurality of small diameter coaxial cables arranged in a flat plane, and a sheath applied onto the outside of the arranged coaxial cables. Each of the small diameter coaxial cables consists of a center conductor of a 0.1 mm to 0.5 mm diameter and an outer conductor of a 0.5 mm to 0.8 mm diameter. In connection between circuit boards or between electronic appliances, the flat cable is connected to the circuit boards or electronic appliances through connectors for the coaxial flat cables.

FIG. 1 illustrates a typical one of multi-contact connectors which have been widely used for this purpose. In FIG. 1, the multicontact connector includes a receptacle connector 2 and a plug connector 5 adapted to be fitted in the receptacle connector 2. The receptacle connector 2 is attached to a circuit board 1. The plug connector 5 has connection terminals 3 arranged in a flat plane in consideration of connection with a flat cable. The flat cable includes a plurality of coaxial cables 8 arranged in a plane and having conductors 7. Reference numeral 4 indicates a ground bar.

FIG. 2*a* is a perspective view illustrating a conventional arrangement of contacts of the multi-contact connector. In FIG. 2*a*, each of the contacts 3 is composed of a connection terminal A to be connected to one of coaxial cables of the flat cable, a fixing portion B to be held in the insulating body of the plug connector, and a contact portion C to be brought into contact with one contact of the receptacle connector.

The references $S_1$, $S_2$, . . . $S_5$ and $S_6$ and $G_1$, $G_2$, . . . $G_5$ and $G_6$ on the contact 3 are intended to designate signal contacts for signals and ground contacts for grounding, respectively. The signal contacts are connected to the center conductors of the coaxial cables, respectively, for signals, while the ground contacts are connected to the outer conductors of the coaxial cables, respectively, for grounding. The numbers of suffixes correspond to the numbers of the coaxial cables of the flat cable to be connected thereto. For example, the signal contact $S_1$ is connected to the center conductor of the first coaxial cable of the flat cable, and the signal contact $S_2$ is connected to the center conductor of the second cable of the flat cable. On the other hand, the ground contact $G_1$ is connected to the outer conductor of the first coaxial cable of the flat cable, and the ground contact $G_2$ is connected to the outer conductor of the second coaxial cable of the flat cable.

The connection terminals A of the contacts 3 are arranged in the order of $G_1$, $S_1$, $G_2$, $S_2$, . . . $G_5$, $S_5$, $G_6$ and $S_6$ as shown in FIG. 2*b* viewed from the side of the connection terminals A. On the other hand, the contact portions C of the contacts 3 are regularly arranged that the signal contacts are in one or upper row as $S_1$, $S_2$, . . . $S_5$ and $S_6$ in the order of the suffixes and the ground contacts are in the other or lower row as $G_1$, $G_2$, . . . $G_5$ and $G_6$ in the order of the suffixes as shown in FIG. 2*c* viewed from the side of the contact portions C.

When a flat cable including coaxial cables is used for connection between electronic appliances and between circuit boards of electronic appliances, crosstalk can be reduced, for example, by approximately 50% in comparison to that of a usual flat cable having a plurality of coated conductors arranged in parallel with one another (in comparison with a transmission cable).

Although such a significant effect can be accomplished by the coaxial flat cable, more decrease of the crosstalk has been expected in the existing circumstances in that the electronic appliances have been required to be more multiple and to be operated at higher speeds.

SUMMARY OF THE INVENTION

It is an object of the invention to provide an electrical connector which meets the existing expectations described above and reduces the crosstalk and serves to improve transmission efficiency without changing the usual arrangement of connection terminals of contacts of the connector.

In order to accomplish the object, with the connector according to the invention, the contact portions of contacts are arranged to fulfill the following conditions without changing the arrangement of the connection terminals.

(1) The connection terminals of plural pairs of signal and ground contacts are alternately arranged in a row in a flat plane in the order of signal contact, ground contact, signal contact . . . or ground contact, signal contact, ground contact . . . .

(2) The contact portions of plural pairs of signal and ground contacts are divided into the upper and lower rows so that some of the signal and ground contacts are included in the upper row and the remaining signal and ground contacts are included in the lower row, and the signal contact or ground contact of each of pairs in one row is substantially opposite to the ground contact or signal contact of the pair in the other row.

(3) In each group of two adjacent pairs of the signal and ground contacts, the signal contact and the ground contact of one pair are in the upper row and the lower row, respectively, while the signal contact and the ground contact of the other pair are in the lower row and the upper row, respectively. In other words, the signal contact portions of the two adjacent pairs are arranged in different rows, respectively, while the ground contact portions of the two adjacent pairs are also arranged in different rows.

As described above, the contact portions of the signal and ground contacts in pairs are arranged in the upper and lower rows, such that the signal contact of one pair of contacts is arranged in the one row and the ground contact of the pair is arranged in the other row, while the signal contact of one pair adjacent the first mentioned one pair is arranged in the other row and the ground contact is arranged in the one row according to the invention. With this arrangement, crosstalk of a connector using the arrangement of contacts is reduced by approximately 5 dB in comparison with that of a connector having the arrangement of contacts of the prior art. This effect is practically significant, although the reason for the reduction of the crosstalk has not been theoretically explained.

In another aspect of the invention, the above object is accomplished by the following arrangement of contacts of the connector.

(1) The contact portions of signal contacts connected to center conductors of coaxial cables of odd numbers and contact portions of ground contacts connected to outer conductors of the coaxial cables are regularly alternately arranged in the order of the number of the coaxial cables in an upper row.

(2) The contact portions of signal contacts connected to center conductors of coaxial cables of even numbers and contact portions of ground contacts connected to outer conductors of coaxial cables of even numbers are regularly alternately arranged in the order of the number of the coaxial cables in a lower row.

By arranging the contact portions of the contacts connected to the coaxial cables of odd numbers in one row and arranging the contact portions of the contacts connected to the coaxial cables of even numbers in the other row in this manner, crosstalk of a connector using the arrangement of contacts is reduced by approximately 10 dB in comparison with that of a connector having the arrangement of contacts of the prior art. The reason for the reduction of the crosstalk has not been theoretically explained.

The invention will be more fully understood by referring to the following detailed specification and claims taken in connection with the appended drawings.

DESCRIPTION OF THE PREFERRED EMBODIMENTS

Figure 3:
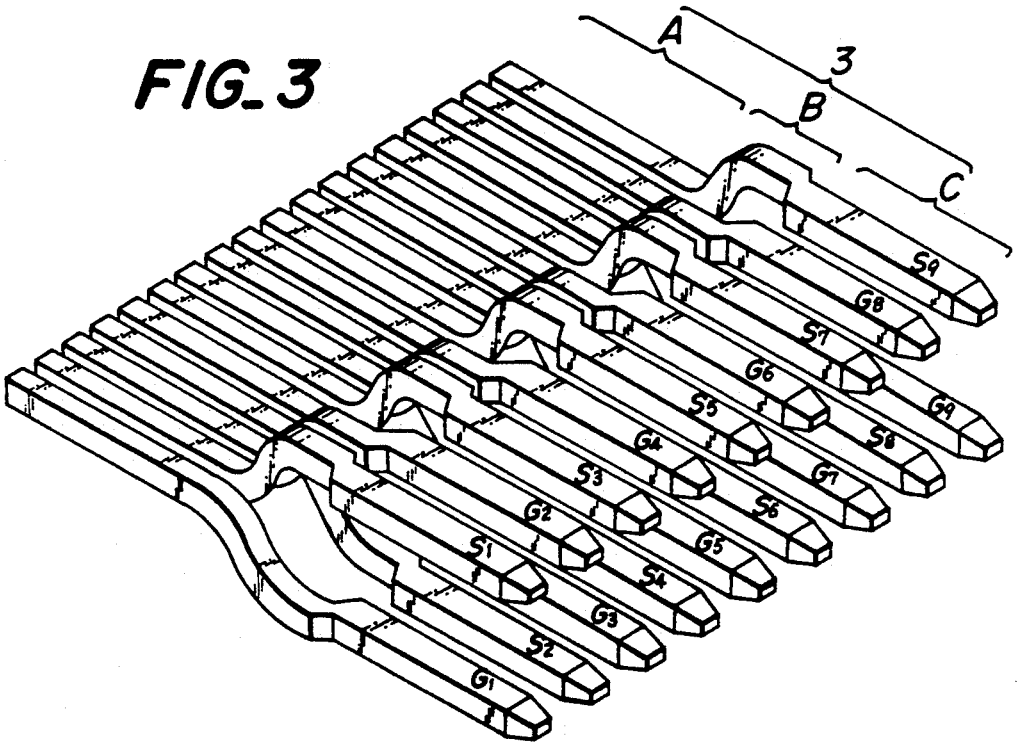
FIG. 3 is a perspective view illustrating an arrangement of contacts according to a first embodiment of the invention.

FIG. 3 illustrates an arrangement of contacts 3 in an electrical connector, particularly, multicontact connector according to the first embodiment of the invention.

Each of the contacts 3 is composed of a connection terminal A to be connected to a center conductor or an external conductor of a coaxial cable, a fixing portion B to be held in the insulating body of the connector, and a contact portion C to be brought into contact with a contact of a mating connector.

Figure 1:
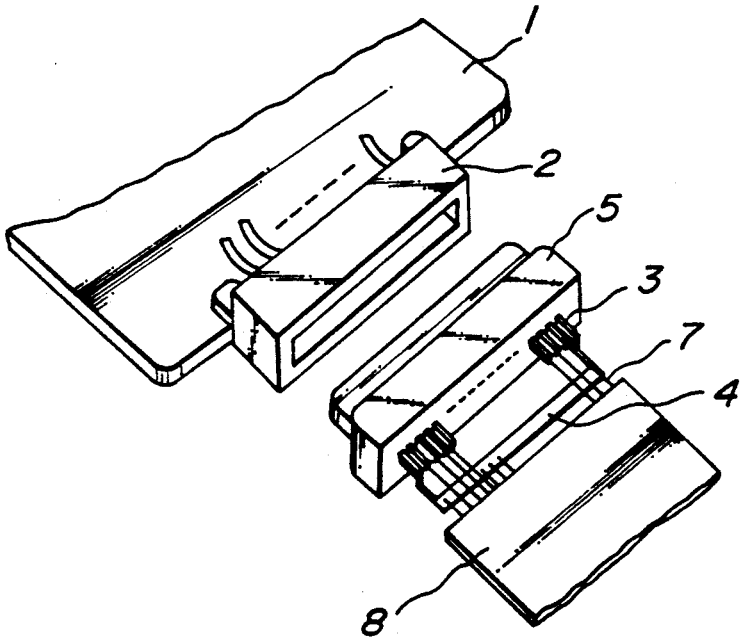
FIG 1 PRIOR ART
FIG. 1 is a perspective view for explaining a connector of the prior art.
Figure 2A:
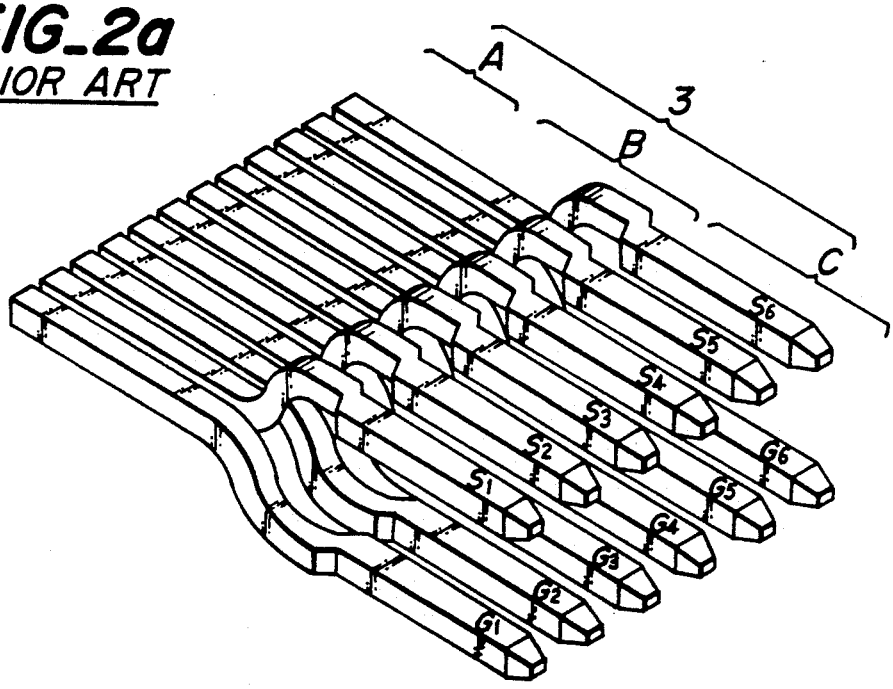
FIG 2a PRIOR ART
FIG. 2*a* is a perspective view illustrating an arrangement of contacts of the prior art.
Figure 2B:
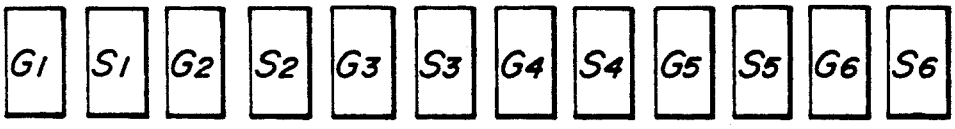
FIG 2b PRIOR ART
FIG. 2*b* illustrates an arrangement of connection terminals of the contacts shown in FIG. 2*a;*
Figure 2C:
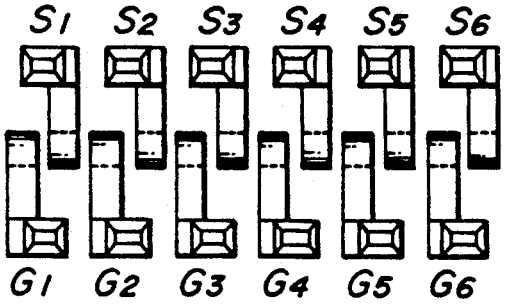
FIG 2c PRIOR ART
FIG. 2*c* illustrates an arrangement of contact portions of the contacts shown in FIG. 2*a;*

References $S_1$, $S_2$, $S_3$, . . . $S_7$, $S_8$ and $S_9$ and $G_1$, $G_2$, $G_3$, . . . $G_7$, $G_8$ and $G_9$ on these contacts are similar to those explained by referring to FIG. 2*a*.

Figure 4A:
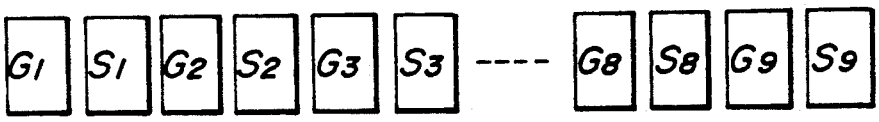
FIG. 4*a* illustrates an arrangement of connection terminals of the contacts shown in FIG. 3.

FIG. 4*a* illustrates the arrangement of the connection terminals of the contacts 3 viewed from the side of the connection terminals in FIG. 3. They are arranged in the order of $G_1$, $S_1$, $G_2$, $S_2$, . . . $G_8$, $S_8$, $G_9$, and $S_9$. This arrangement is also similar to that of the prior art.

Figure 4B:
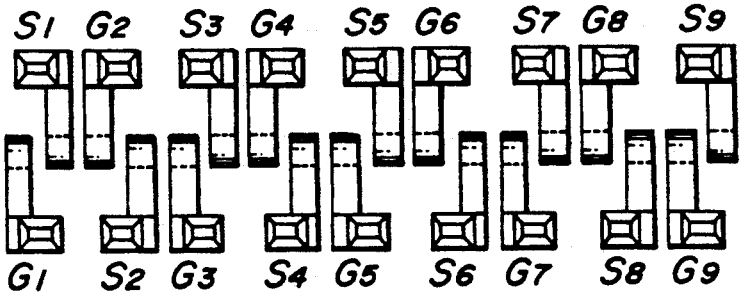
FIG. 4*b* illustrates an arrangement of contact portions of the contacts shown in FIG. 3.

According to the invention, however, the contact portions of the signal contacts $S_1$, $S_2$, . . . $S_8$ and $S_9$ and the ground contacts $G_1$, $G_2$, . . . $G_8$ and $G_9$ are arranged so that the signal contact of each of the pairs in the upper or lower row is opposite to the ground contact of the pair in the lower or upper row as shown in FIG. 4*b* viewed from the contact portions. Moreover, the signal contact of a pair of the contacts and the ground contact of a pair adjacent to the pair are in one row, and the ground contact of the one pair and the signal contact of the adjacent pair are in the other row. In other words, in the embodiment shown in FIG. 4*b*, the signal contact $S_1$, ground contact $G_2$, signal contact $S_3$, ground contact $G_4$, . . . ground contact $G_8$ and signal contact $S_9$ are arranged in the upper row in this order from left to right, while the ground contact $G_1$, signal contact $S_2$, ground contact $G_3$, signal contact $S_4$, . . . signal contact $S_8$ and ground contact $G_9$ are arranged in the lower row in this order from left to right.

Figure 5:
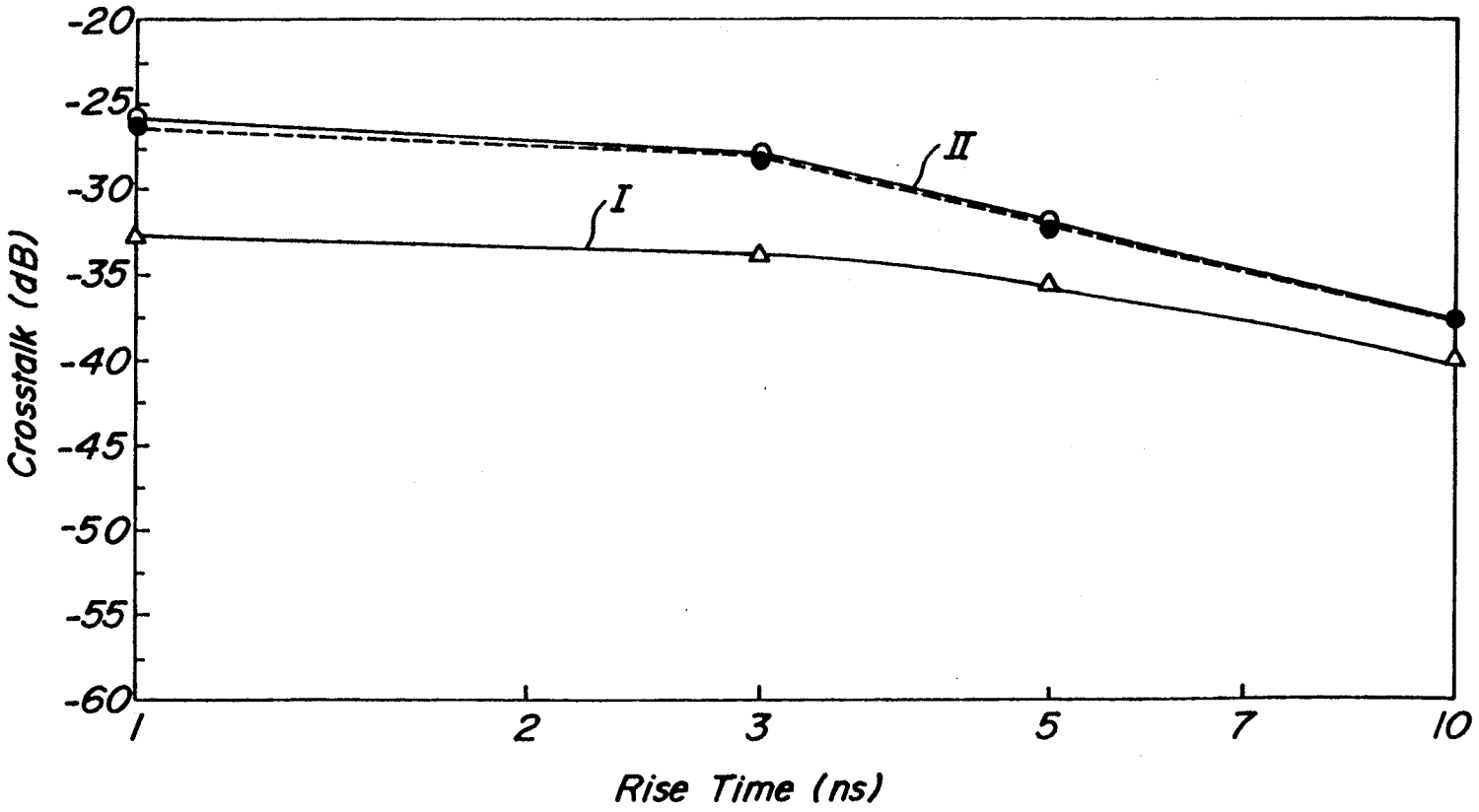
FIG. 5 is a graph illustrating results of an experiment for comparing crosstalk of the connector according to the first embodiment with that of the connector of the prior art.

FIG. 5 illustrates the result of an experiment for comparing crosstalks of the multicontact electrical connector according to this embodiment with those of the prior art. In the graph of FIG. 5 illustrating the crosstalk (dB) in the ordinate and rise time (ns) in the abscissa, the curve I indicates the crosstalks of the connector according to the invention and lines II indicate those of the prior art connector.

With the multicontact electrical connector according to this embodiment having the arrangement of the contacts described above and shown in FIG. 3, the crosstalks are lower than those in the connector of the prior art by 5 dB or more over all the rise time (ns) as shown in FIG. 5. It is clear that the connector according to the invention is superior in the transmission characteristics.

According to this embodiment, moreover, the connection terminals A of the contacts 3 are arranged side by side in a flat plane. Therefore, the multicontact electrical connector according to this invention is very easily connected to a coaxial flat cable so that a reliable connection therebetween can be accomplished.

Figure 6:
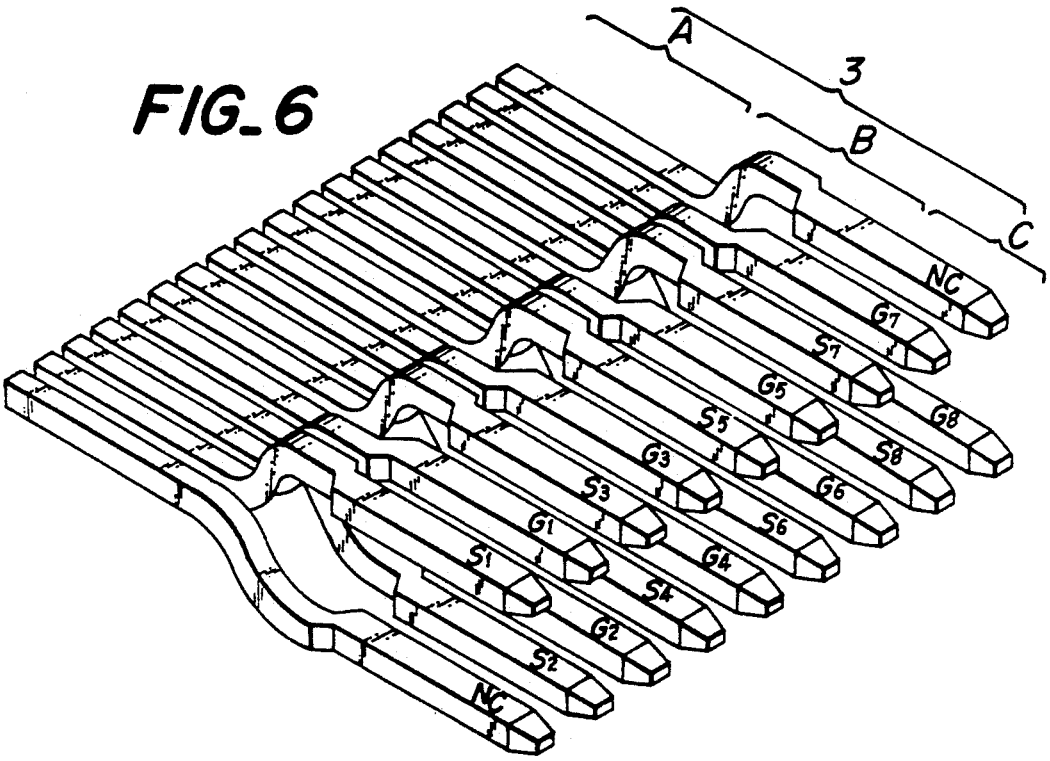
FIG. 6 is a perspective view illustrating an arrangement of contacts according to a second embodiment of the invention.

FIG. 6 is a perspective view illustrating another arrangement of contacts 3 of an electrical connector according to the second embodiment of the invention, wherein like parts are designated by the same reference numerals as in the first embodiment.

Figure 7A:
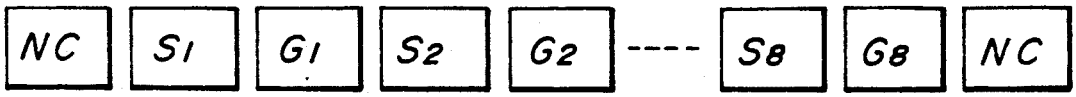
FIG. 7*a* illustrates an arrangement of connection terminals of the contacts shown in FIG. 6.

Connection terminals of the contacts 3 are arranged in the order of $S_1$, $G_1$, $S_2$, $G_2$, . . . $S_8$ and $G_8$ as shown in FIG. 7*a* viewed from the side of the connection terminals. This arrangement is similar to that of the prior art.

Figure 7B:
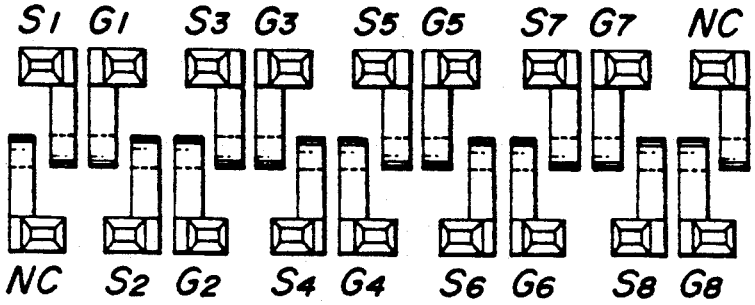
FIG. 7*b* illustrates an arrangement of contact portions of the contacts shown in FIG. 6.

FIG. 7*b* illustrates the arrangement of contact portions of the contacts 3 viewed from their sides. As shown in FIG. 7*b*, the signal contacts and the ground contacts connected to the coaxial cables of odd numbers of a flat cable are arranged in the upper row as $S_1$, $G_1$, $S_3$, $G_3$, $S_5$, $G_5$, $S_7$ and $G_7$ in the order of the numbers of the coaxial cables. The signal contacts connected to center conductors of the coaxial cables and the ground contacts connected to external conductors of the coaxial cables are regularly alternately arranged as $S_1$, $G_1$, $S_3$, $G_3$, $S_5$, $G_5$, $S_7$ and $G_7$.

Moreover, the signal contacts and the ground contacts connected to the coaxial cables of even numbers of the flat cable are arranged in the lower row as $S_2$, $G_2$, $S_4$, $G_4$, $S_6$, $G_6$, $S_8$ and $G_8$ in the order of the numbers of the coaxial cables and regularly alternately. The signal contacts connected to center conductors of the coaxial cables and the ground contacts connected to external conductors of the coaxial cables are regularly alternately arranged as $S_2$, $G_2$, $S_4$, $G_4$, $S_6$, $G_6$, $S_8$ and $G_8$.

The signal contacts and the ground contacts in the upper and lower rows are substantially in opposition to each other.

With the arrangement of the signal contacts and ground contacts described above, there are vacant positions of contacts at one end of the upper row and the opposite end of the lower row. It is not necessarily needed to arrange contacts at the vacant positions. In the embodiment shown in FIG. 6, contacts NC not to be connected to the flat cable are arranged at the vacant positions.

Figure 8:
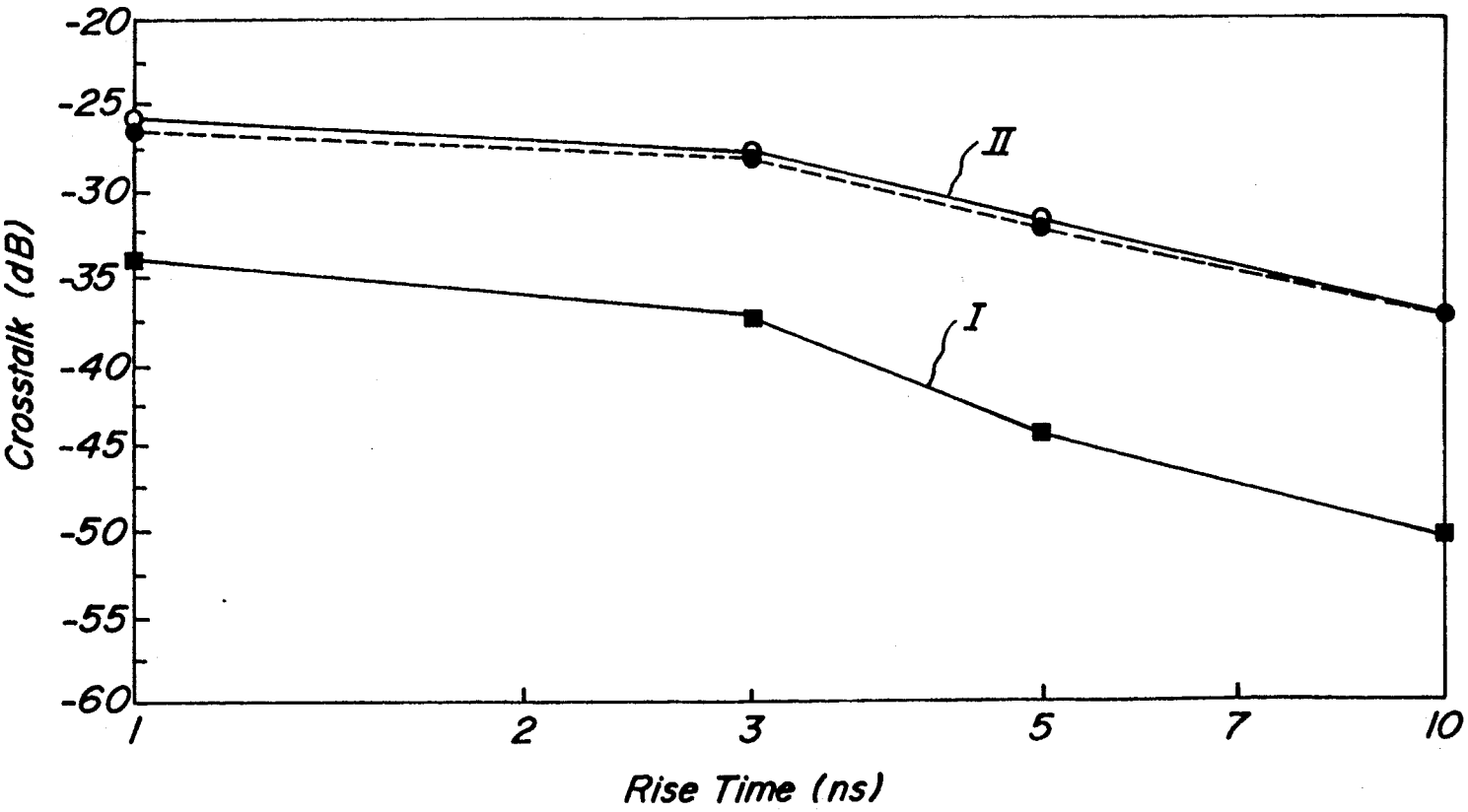
FIG. 8 is a graph illustrating results of an experiment for comparing crosstalk of the connector according to the second embodiment with that of the connector of the prior art.

FIG. 8 illustrates the result of an experiment for comparing crosstalks of the connector according to this embodiment with those of the prior art. The lines I in the graph of FIG. 8 indicate the crosstalks of the connector according to the embodiment and the lines II indicate those of the prior art connector.

With the connector according to this embodiment having the arrangement of the contacts described above, the crosstalks are lower than those in the connector of the prior art by 10 dB or more over all the rise time (ns) as shown in FIG. 8. The connector according to the embodiment is likewise superior in the transmission characteristics.

According to this embodiment, moreover, the connection terminals A of the contacts 3 are arranged side by side in a flat plane, and the signal contacts to be connected to the center conductors and the ground contacts to be connected to the external conductors of coaxial cables of a flat cable are regularly alternately arranged. By virtue of these arrangements, the connector is very easy to connect to a coaxial flat cable and hence able to provide a reliable connection therebetween which is a significant effect of the invention.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector for a coaxial flat cable comprising:

a plurality of contacts, each of said plurality of contacts including a connection terminal, a fixing portion and a contact portion;

an insulating body for fixing said contacts at said fixing portion against said insulating body;

said connection terminals of the contacts are arranged in a first row in a first plane for connecting to center conductors and outer conductors of successive coaxial cables of the coaxial flat cable;

said contact portions arranged in a set having a ground contact and a signal contact with each contact of said set separately arranged to form a second row and a third row, said second row being spaced from and parallel to said third row;

said contact portions of said plurality of contacts in said second and third rows arranged with a constant pitch (P) and a minimum separating distance (L) between the second row and third row to satisfy a relationship, $$L > P$$

and by the above arrangement, the mutual positional relationship of said each set of said plurality of contacts in the second row and third row being arranged in a staggered relationship with a shift in pitch (P) of the arrangement.

* * * * *